US006389774B1

(12) United States Patent
Carpenter

(10) Patent No.: US 6,389,774 B1
(45) Date of Patent: May 21, 2002

(54) PIPE DOWEL FOR CONCRETE SLAB CONSTRUCTION

(76) Inventor: Gregory Howard Carpenter, 17550 Bowser Rd., Lodi, CA (US) 95240

( * ) Notice: Subject to any disclaimer, the term of this patent is extended or adjusted under 35 U.S.C. 154(b) by 0 days.

(21) Appl. No.: 09/783,245

(22) Filed: Feb. 13, 2001

(51) Int. Cl.[7] ..... E01C 11/14

(52) U.S. Cl. ..... 52/585.1; 52/396.02; 52/396.04; 52/583.1; 52/741.11; 404/52; 404/59

(58) Field of Search ..... 52/318, 396.02, 52/396.04, 402, 414, 583.1, 585.1, 677, 704, 740.7, 742.14, 741.11; 404/52, 59, 60, 62, 63

(56) References Cited

U.S. PATENT DOCUMENTS

| | | | | | |
|---|---|---|---|---|---|
| 2,080,124 | A | * | 5/1937 | Friberg | 52/396.02 |
| 2,278,917 | A | * | 4/1942 | Curry | 404/136 |
| 3,437,017 | A | * | 4/1969 | Walz et al. | 404/60 |
| 4,114,344 | A | | 9/1978 | Heasman | |
| 4,449,844 | A | * | 5/1984 | Larsen | 404/60 |
| 4,834,576 | A | * | 5/1989 | Argento | 404/62 |
| 5,005,331 | A | | 4/1991 | Shaw et al. | |
| 5,216,862 | A | | 6/1993 | Shaw et al. | |
| 5,404,689 | A | * | 4/1995 | DiNarda | 52/699 |
| 5,678,952 | A | * | 10/1997 | Shaw et al. | 404/62 |
| 5,713,174 | A | | 2/1998 | Kramer | |
| 5,797,231 | A | * | 8/1998 | Kramer | 52/396.02 |
| 5,867,960 | A | | 2/1999 | Andraet et al. | |
| 5,934,821 | A | | 8/1999 | Shaw et al. | |
| 5,941,045 | A | | 8/1999 | Plehanoff et al. | |
| 6,092,960 | A | | 7/2000 | McCallion | |
| 6,210,070 | B1 | * | 4/2001 | Shaw et al. | 404/70 |

* cited by examiner

*Primary Examiner*—Beth A. Stephan
*Assistant Examiner*—Brian E. Glessner
(74) *Attorney, Agent, or Firm*—Mark J. Spolyar

(57) ABSTRACT

Methods, apparatuses and systems directed to joint restraining systems for concrete constructions. In one embodiment, the present invention is a novel method for creating joint restraints that employs a pipe dowel. As more fully described below, the present invention substantially reduces the time and labor involved in tying a series of parallel dowels into a rebar matrix. For example, the present invention eliminates the need to cut out sections of rebar. Rather, embodiments of the present invention require only a single cut in each rebar section along the line of the intended joint, rather than two cuts to remove a section of rebar. The present invention also eliminates the time and effort associated with tying dowels into the rebar matrix. In another embodiment, the present invention is a novel pipe dowel mechanism that, in addition to the advantages described above, obviates the need to apply a messy protective coating, such as grease, to a smooth dowel. Moreover, the present invention reduces the potential for misalignment of the dowels as the rebar matrix is manipulated and otherwise disturbed during a concrete pour.

17 Claims, 3 Drawing Sheets

PIPE DOWEL FOR CONCRETE SLAB CONSTRUCTION

FIELD OF THE INVENTION

The present invention relates to concrete slab construction and, more particularly, to methods, apparatuses, and systems directed toward concrete joint restraining systems using pipe dowel mechanisms.

BACKGROUND OF THE INVENTION

It is well known that concrete expands and contracts due to changes in temperature and moisture. In addition, concrete also contracts as a result of the curing process. In these instances stresses develop that can lead to cracking. Indeed, because concrete slabs can experience large temperature changes over the course of a calendar year, accommodations must be made for the resulting expansion and contraction of the concrete. The thermal expansion and contraction of the concrete under these conditions can prove destructive, leading to undesirable cracking and surface discontinuities if preventive measures are not taken.

To address these problems, engineers employ joints or spacing between concrete slab sections to accommodate thermal expansion and contraction of the concrete. Transverse joints can be saw cut, placed through induced cracking, or formed at pre-determined spacings. Strategic placement of the joints facilitates control of the direction of the expansion and the location where the concrete will crack as a result of the curing process and/or subsequent expansion and contraction. The use of joints or spacing between concrete slab sections, however, has associated problems. Uneven expansion or contraction of the individual sections can result in discontinuities in the slab which, in turn, can lead to unsatisfactory conditions, as well as stress and fatigue in the individual sections. For instance, individual sections can rise or shift relative to adjacent sections to create an uneven surface. To solve this problem, engineers have used dowel bars placed longitudinally in the sections to allow the concrete sections to expand in the longitudinal direction but resist uneven expansion between adjacent sections in the traverse direction of the dowels. For example, by controlling expansion of the sections, engineers can prevent the upper surface of the pavement from becoming discontinuous and uneven.

In addition, it is common to attach the smooth dowels at various points in the rebar matrix that reinforces the concrete. Specifically, before a concrete slab is poured, a rebar matrix is constructed over the desired location (or grade) of the concrete slab. In one form, a rebar matrix is assembled for the entire intended area of the slab. Then, sections of rebar are cut from the matrix, both in the longitudinal and lateral directions, to create a plurality of adjacent rebar matrix sections each having several rebar members extending therefrom in substantial alignment with rebar members of adjacent sections, but spaced apart at a distance determined by the length of the removed sections. Steel dowels are then tied to the substantially aligned rebar sections to span the respective gaps created by the removed sections. The concrete is then poured starting with one section and then moving to adjacent sections until the entire concrete slab is poured. However, this technique has problems beyond the labor intensive nature of tying a large number dowels to the exposed rebar members. Alignment of adjacent dowel bars in a parallel orientation in each section is critical to proper movement of the concrete sections. The tied dowels, however, often become misaligned as trucks and other equipment run over the rebar matrix, and/or as rebar matrix sections are raised during pouring of the concrete, such as with the laser screeding method. Indeed, the tied dowels often become misaligned due to the tie wires breaking and/or due to bending of the rebar members to which the dowels are attached. Moreover, the use of steel dowels often requires the use of protective coatings to ensure that the concrete does not adhere to the dowel and, thereby, prevent slippage of the concrete over the dowel during expansion and contraction. One prior art method is to coat the steel dowels with grease or the like. This process is both messy and time consuming.

In light of the foregoing, a need exists for methods, apparatuses and systems that provide a dowel mechanism for concrete slab construction that solves the problems identified above.

SUMMARY OF THE INVENTION

The present invention provides methods, apparatuses and systems directed to joint restraining systems for concrete constructions. The present invention employs a pipe dowel that eliminates many of the problems in the prior art identified above. In one embodiment, the present invention is a novel method for creating joint restraints that employs a pipe dowel. As more fully described below, the present invention substantially reduces the time and labor involved in fixing smooth dowels into a rebar matrix. For example, the present invention eliminates the need to cut out sections of rebar. Rather, embodiments of the present invention require only a single cut in each rebar section along the line of the intended joint, rather than two cuts to remove a section of rebar. The present invention also eliminates the time and effort associated with tying dowels into the rebar matrix. In another embodiment, the present invention is a novel pipe dowel mechanism that, in addition to the advantages described above, obviates the need to apply a protective coating, such as grease, to a smooth dowel. Moreover, the present invention reduces the potential for misalignment of the dowels as the rebar matrix is manipulated and otherwise disturbed during a concrete pour.

The pipe dowel and associated methods of the present invention can be used in any application requiring dowels used in concrete joints, including control and construction joints. For example, the present invention has especial application to any controlled slab on grade pour for which dowels are called. Moreover, the present invention has application in a variety of concrete construction methods. For example, the present invention can be incorporated into processed involving laser screeding, Texas screeding, hand rod screeding, and vibration screeding.

DESCRIPTION OF PREFERRED EMBODIMENT(S)

Figure 1:
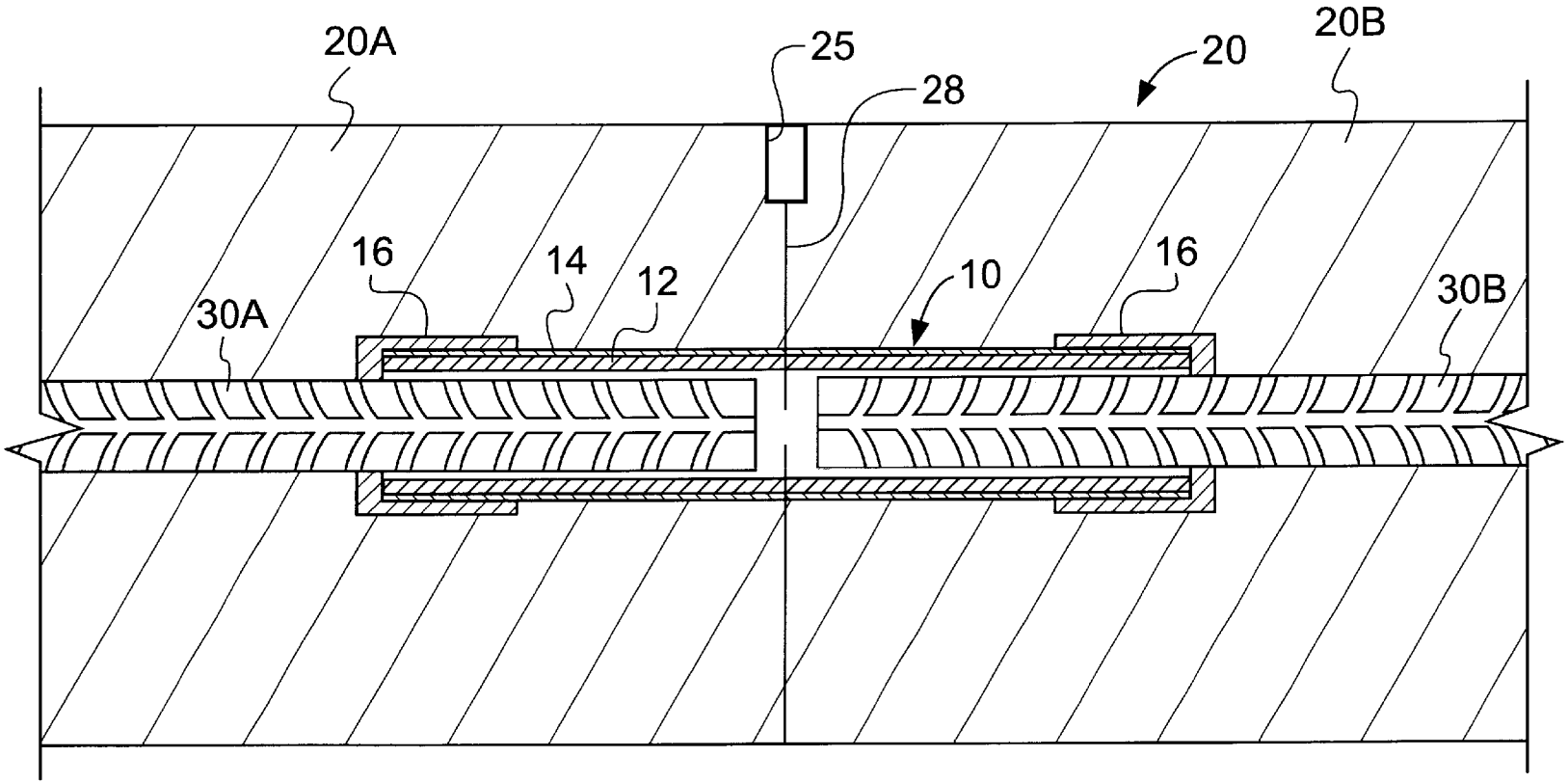
FIG. 1 is a cross section view of a joint restraint according to one embodiment of the present invention.
Figure 3:
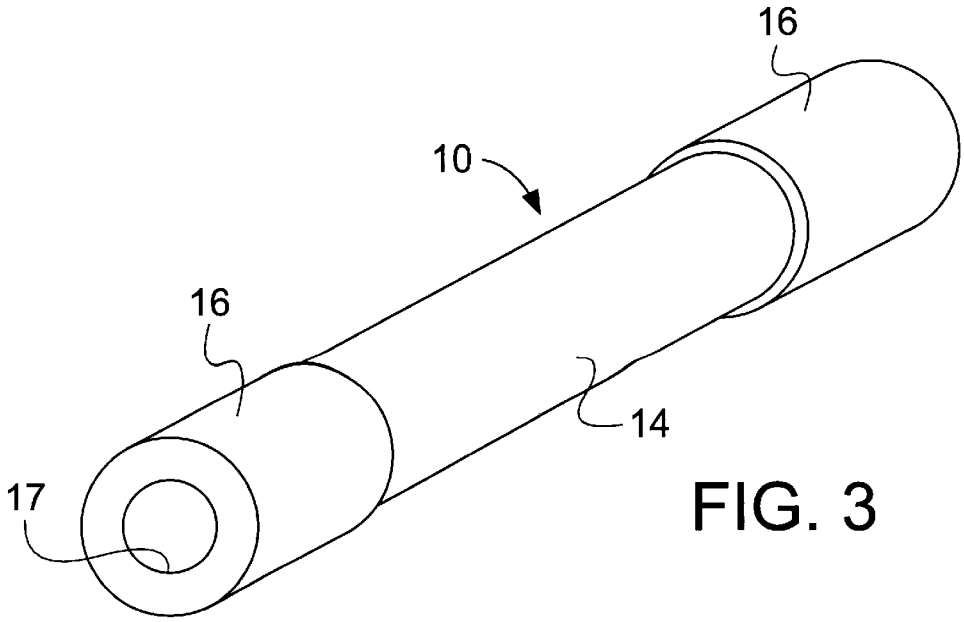
FIG. 3 is a perspective view of a pipe dowel according to one embodiment of the present invention.
Figure 4:
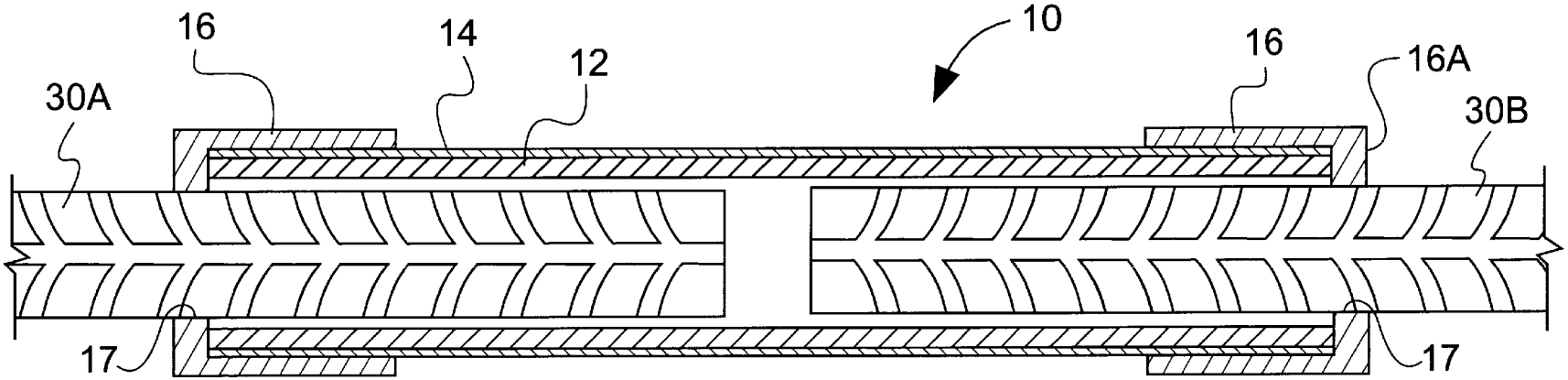
FIG. 4 is a cross sectional view of a pipe dowel according to an embodiment of the invention.

FIGS. 1, 3 and 4 show an embodiment of the pipe dowel according to the present invention. FIG. 1 illustrates the joint restraining system that is created according to one embodiment of the present invention. As FIG. 1 provides, concrete slab 20 is divided into two slab sections 20A and 20B along a crack 28 that was induced by saw cut 25. As is conventional, concrete slab 20 includes reinforcing rebar, including rebar members 30A and 30B in substantial alignment. As FIG. 1 shows, pipe dowel mechanism 10 is disposed over and spans the gap between rebar members 30A and 30B.

As FIG. 4 provides, pipe dowel 10 comprises tubular member 12, lubricating layer 14 and end caps 16. The inner diameter of tubular member 12 is dimensioned to easily slide onto rebar members 30A and 30B. In one form, the inner diameter of tubular member 12 allows tubular member 12 to loosely fit over rebar members 30A and 30B to thereby allow the rebar members to move within tubular member 12 as concrete slab sections 20A and 20B expand and contract. As FIG. 4 shows, tubular member 12, in one form, is dimensioned such that there is a small gap between the inner diameter of tubular member and rebar members 30A and 30B, respectively. Accordingly, the exact dimensions as well as the cross sectional shape of tubular member 12 depend on the outer diameter and shape of rebar members 30A and 30B. For example and in one embodiment, the inner diameter of pipe dowel 10 intended for use with ⅜" rebar is ½ inches, which creates a 1/16" gap between the outer surface of the rebar and the inner diameter of tubular member 12. As further examples, a pipe dowel intended for use with ½" rebar has a ⅝" inner diameter. Similarly, a pipe dowel intended for use with ⅝" rebar has, in one embodiment, an inner diameter of 13/16 inches. In addition, tubular member 12, in one embodiment, is a section of steel pipe or tubing; however, any suitable material can be used provided it has sufficient material strength to function as a dowel. Furthermore, the length of the dowel is determined by the requirements of the particular application. In one embodiment, however, the length of pipe dowel 10 is about 7 inches.

Pipe dowel 10 further includes lubricating layer 14 disposed over the outer surface of tubular member 12. Lubricating layer 14 prevents the concrete from adhering to the outer surface of tubular member 12 as it cures to allow the concrete to slide along the outer surface of pipe dowel 10 during expansion and/or contraction. Lubricating layer 14, in one embodiment, is a sheet of thin plastic wrapped around tubular member 12. In one embodiment, end caps 16 hold lubricating layer 14 in place around tubular member 12. Lubricating layer 14 can comprise any suitable material including, but not limited to, polypropylene, polyethylene, polybutylene and the like. Lubricating layer 14, however, can also be a plastic or other polymeric coating applied (e.g., sprayed, etc.) to the outer surface of tubular member 12. In one embodiment, the concrete adheres to or grips lubricating layer 14 and pulls lubricating layer 14 apart (at substantially the central region thereof as the concrete sections 20A and 20B (see FIG. 1) contract during the curing process and create a joint along crack 28 induced by say cut 25.

Lastly, pipe dowel 10 also includes end caps 16 each having hole 17 there through. As FIG. 4 shows, hole 17 is dimensioned to contact the outer surface of rebar members 30A and 30B to resist movement of the pipe dowel (once it has been placed in position) caused by external forces, such as heavy equipment running over pipe dowel 10. Moreover, holes 17 in end caps 16 are also dimensioned to minimize and, in a preferred form, exclude concrete from entering inside tubular member 12. In one embodiment, hole 17 is dimensioned to allow a construction worker to place pipe dowel 10 over rebar members 30A and 30B and provide a ratchet-like effect as the edge of hole 17 slides over the textured outer surface of the rebar. In a preferred form, end caps 16 comprise a flexible plastic material, such as vinyl, to allow end caps 16 to grip the outer surface of rebar members 30A and 30B, but also to be easily slid over their outer surface.

Figure 2:
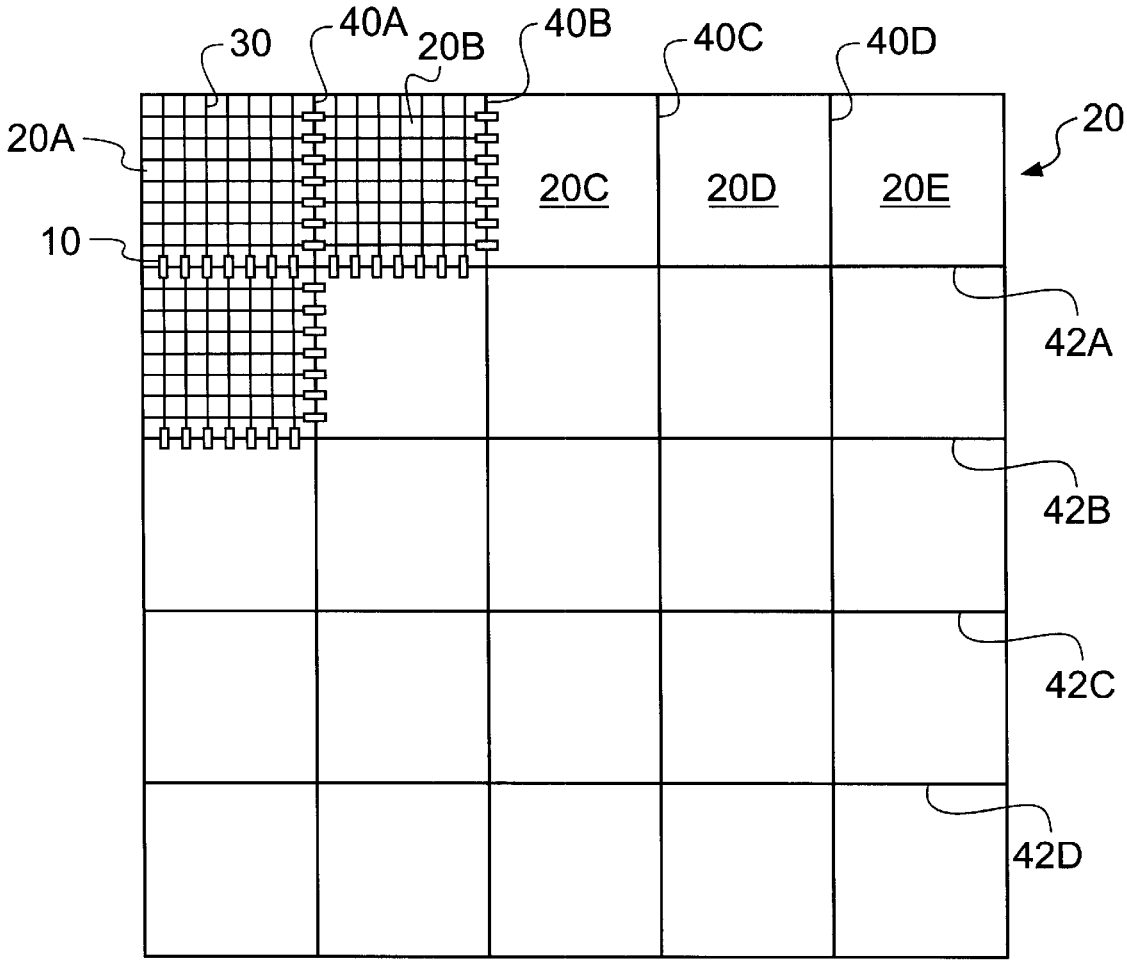
FIG. 2 is a schematic plan view of a concrete slab section including pipe dowels according to an embodiment of the present invention.

FIG. 2 is a schematic view of a concrete slab 20 including a plurality of slab sections (e.g., see Ref. Nos. 20A, 20B, 20C, 20D 20E) divided by longitudinal joint lines 40A–40D and lateral joint lines 42A–42D. As is conventional, rebar 30 oriented in a matrix reinforces concrete slab 20. For purposes of illustration, the rebar matrix is shown in only three sections; however, the rebar matrix, in one embodiment, extends throughout the concrete slab 20. FIG. 2 also shows the position of pipe dowels 10 oriented between adjacent rebar matrix sections substantially along the longitudinal and lateral joint lines.

In practice, the rebar matrix is assembled, in one embodiment, by either tying rebar members 30 in a matrix or by laying welded sheets of rebar over the grade. Of course, the exact method used to construct the rebar matrix is not critical to the present invention. The resulting rebar matrix is then cut using a steel saw, such as a "quicky" saw with a carbide steel cutting blade, substantially along longitudinal lines 40A–40D and lateral lines 42A–42D. The cuts in the rebar matrix create a plurality of matrix sections each having rebar members (see FIG. 1, Ref. Nos. 30A and 30B) in substantial alignment with corresponding rebar members of adjacent rebar matrix sections. As the various Figures illustrate, pipe dowels 10 are placed over the substantially aligned rebar members 30A and 30B and span the gaps there between created by the cuts. According to one embodiment, either one of rebar members 30A and 30B is lifted slightly to permit placement of pipe dowel 10 thereon. In one form, pipe dowel 10 is slid along rebar member 30A such that the outer surface 16A (see FIG. 4) of end cap 16 clears rebar member 30B as rebar member 30A is lowered back in position. Pipe dowel 10 is then slid over rebar member 30B substantially as shown in FIG. 4.

Depending on the construction method, the rebar matrix is raised off the grade and the concrete poured and leveled. As discussed above, end caps 16 help to prevent concrete from entering the gap between tubular member 12 and rebar members 30A and 30B. In one embodiment, the rebar matrix sections are raised off the ground with dobbies. In one form, only the rebar matrix sections over which concrete is currently poured are raised off the ground, permitting concrete trucks to drive over the remaining unraised matrix sections without causing substantial damage. In another form, the entire rebar matrix is raised off the grade before the concrete is poured. A variety of screeding methods can be used with the present invention. For example, the present invention can incorporate laser screeding (where the matrix sections are lifted as the concrete pour moves from section to section), Texas screeding (where the entire rebar matrix is lifted off the ground), hand rod screeding (i.e., employing a hand rod to level off the concrete), and/or vibration screeding (where a motor vibrates the concrete as it is poured to promote a level upper surface). Lastly, after the concrete has cured, a saw cut (e.g., FIG. 1, Ref. No. 25) is made along the longitudinal and lateral joint lines to promote controlled cracking of the concrete at the joint lines.

The foregoing description illustrates the principles of the present invention and provides examples of its implementation. As one skilled in the art will recognize, many variations on the above-described embodiments are possible, while still employing the present invention. For example, the method of the present invention need not be practiced with the pipe dowel mechanism described herein. In its essential form, the method of the present invention may be practiced, although in a less preferred mode, merely with a conventional steel pipe without the lubricating layer and/or end caps. Accordingly, the description is not intended to limit the scope of the claims to the exact embodiments shown and described.

What is claimed is:

1. An apparatus providing a joint restraint system for concrete slab constructions, comprising:

a tubular member, a lubricating layer disposed around the outer surface of the tubular member, a first plastic end cap disposed over a first end of the tubular member, a second plastic end cap disposed over a second end of the tubular member, wherein the first and second plastic end caps each have a hole extending there through dimensioned to resist movement of the apparatus once it is placed around a rebar member.

2. The apparatus of claim 1 wherein the tubular member is made of steel.

3. The apparatus of claim 1 wherein the lubricating layer comprises a thin polymeric sheet.

4. The apparatus of claim 1 wherein the lubricating layer comprises a polymer coating.

5. The apparatus of claim 1 wherein the plastic end caps are vinyl.

6. An assembly facilitating the creation of joint restraints in a concrete slab, comprising:

a first rebar matrix section having a first plurality of rebar members extending therefrom, a second rebar matrix section having a second plurality of rebar members extending therefrom, wherein at least one rebar member extending from the first rebar matrix section and at least one corresponding rebar member extending from the second rebar matrix section are in substantial alignment, at least one tubular member slidably disposed over at least one pair of the substantially aligned rebar members, a lubricating layer disposed around the outer surface of the at least one tubular member, a first end cap disposed over a first end of the at least one tubular member, a second end cap disposed over a second end of the at least one tubular member, wherein the first and second end caps each have a hole extending there through dimensioned to resist movement of the at least one tubular member once it is placed around a rebar membered.

7. The assembly of claim 6 wherein the first and second rebar matrix sections rest on dobbies.

8. The assembly of claim 6 wherein the assembly is embedded in a concrete slab.

9. The assembly of claim 7 wherein the assembly is embedded in a concrete slab.

10. The assembly of claim 8 wherein the concrete slab includes at least one saw cut located over the tubular member.

11. The assembly of claim 6 wherein the end caps grip the respective rebar members to resist movement of the at least one tubular member along the rebar members.

12. A method allowing for creation of a joint restraining system in a concrete slab, the method comprising the steps of (a) assembling a rebar matrix;

(b) cutting the rebar matrix to form at least two separate and adjacent rebar matrix a sections each having a plurality of rebar members extending therefrom and in substantial alignment with rebar members extending from adjacent rebar matrix sections; and, (c) placing a tubular member over at least one pair of substantially aligned rebar members, wherein the inner diameter of the tubular member is dimensioned to allow the tubular member to slide over the rebar members.

13. The method of claim 12 further comprising the steps of (d) pouring concrete over the rebar matrix sections.

14. The method of claim 12 further comprising the steps of (d) raising the first and second rebar matrix sections; and, (e) pouring concrete over the first and second rebar matrix sections.

15. The method of claim 14 further comprising steps of (f) after curing of the concrete, making a linear cut in the concrete substantially over the tubular member(s).

16. The method of claim 12, 13, 14, or 15 wherein the tubular member comprises a tubular member, a lubricating layer disposed around the outer surface of the tubular member, a first end cap disposed over a first end of the tubular member, a second end cap disposed over a second end of the tubular member, wherein the first and second end caps each have a hole extending there through.

17. The method of claim 16 wherein the holes in the first and second end caps are dimensioned to conform to the outer surface of the rebar members.

* * * * *

UNITED STATES PATENT AND TRADEMARK OFFICE

CERTIFICATE OF CORRECTION

PATENT NO. : 6,389,774 B1
DATED : May 21, 2002
INVENTOR(S) : Gregory Howard Carpenter It is certified that error appears in the above-identified patent and that said Letters Patent is hereby corrected as shown below:

Column 5,
Line 53, delete “membered” and insert therefor -- member --.

Column 6,
Line 18, delete the first occurrence of “a”.

Signed and Sealed this

Ninth Day of July, 2002

*Attest:*

*Attesting Officer*

JAMES E. ROGAN
*Director of the United States Patent and Trademark Office*